US008365694B2

(12) United States Patent
Suzuki et al.

(10) Patent No.: US 8,365,694 B2
(45) Date of Patent: Feb. 5, 2013

(54) EASILY REMOVABLE SPARK PLUG

(75) Inventors: Akira Suzuki, Aichi (JP); Yuichi Nakano, Aichi (JP); Mamoru Musasa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 281 days.

(21) Appl. No.: 12/451,573

(22) PCT Filed: Aug. 1, 2008

(86) PCT No.: PCT/JP2008/063856

§ 371 (c)(1),
(2), (4) Date: Nov. 19, 2009

(87) PCT Pub. No.: WO2009/017220

PCT Pub. Date: Feb. 5, 2009

(65) Prior Publication Data

US 2010/0117506 A1 May 13, 2010

(30) Foreign Application Priority Data

Aug. 1, 2007 (JP) ..... 2007-200629

(51) Int. Cl.
*H01T 13/08* (2006.01)

(52) U.S. Cl. ..... 123/169 R; 313/144; 313/135

(58) Field of Classification Search ..... 313/118–145; 123/169 R, 169 EL, 32, 41, 310; 445/7; 81/176.1, 81/176.2, 120; 411/402
See application file for complete search history.

(56) References Cited

U.S. PATENT DOCUMENTS 6,741,015 B2 * 5/2004 Suzuki et al. ..... 313/143
2005/0002756 A1 * 1/2005 Oleszek ..... 411/402

FOREIGN PATENT DOCUMENTS

JP S57-59070 4/1982
JP 2002-050449 2/2002
JP 2002-252071 9/2002
JP 2006-059588 3/2006

OTHER PUBLICATIONS

International Preliminary Report on Patentability (IPRP) and Written Opinion for International Application No. PCT/JP2008/063856, Mar. 4, 2010.
International Search Report for International Application No. PCT/JP2008/063856, Oct. 14, 2008.

* cited by examiner

*Primary Examiner* — Anh Mai
*Assistant Examiner* — Fatima Farokhrooz
(74) *Attorney, Agent, or Firm* — Kusner & Jaffe

(57) ABSTRACT

A spark plug comprised of a spark plug main body and a cylindrical pressing member used for mounting the spark plug main body on an internal-combustion engine. The spark plug main body includes a cylindrical metal shell. A removing-tool engagement portion is formed on an outer circumferential face of the metal shell at a front end side of a caulking portion. The removing-tool engagement portion is used for engaging with a tool, when removing the spark plug main body from a plug hole of an internal-combustion engine.

13 Claims, 5 Drawing Sheets

EASILY REMOVABLE SPARK PLUG

FIELD OF THE INVENTION

The present invention relates to a spark plug used for internal-combustion engines, such as automotive engines.

BACKGROUND OF THE INVENTION

A conventional spark plug is supplied to a combustion chamber of an internal-combustion engine for the purpose of igniting an air-fuel mixture. The spark plug discharges a spark in a discharge gap formed between a center electrode and a ground electrode that faces a front end of the center electrode.

Such a spark plug is normally fixed to an internal-combustion engine with a male thread of a metal shell of the spark plug engaging with a female thread provided in a plug hole of the internal-combustion engine.

Further, it has been disclosed that a spark plug has a separate male thread formed on an outer face of a cylindrical pressing member, instead of forming it on the metal shell. The male thread of the cylindrical pressing member is engaged with a female thread provided in the plug hole of the internal-combustion engine, and then a spark plug main body is pressed and tightened (i.e., secured) in the internal-combustion engine. For example, see Japanese Patent Application Laid-Open (kokai) No.2002-050449.

A spark plug having a composition wherein a spark plug main body is fixed to an internal-combustion engine using the above-described cylindrical pressing member has the following problems. That is, such a spark plug does not have a male thread on the metal shell for fixing the spark plug to the internal-combustion engine. Therefore, a spark plug main body must be pulled out from a plug hole of the internal-combustion engine, after removing the cylindrical pressing member, when removing the spark plug from the internal-combustion engine. However, the spark plug main body tends to get stuck in the plug hole due to soot and sediment piled up in a clearance between the plug hole and the metal shell, and thus it is difficult to remove the spark plug main body from the plug hole.

The present invention is accomplished in light of the above-mentioned problems, and an object of the present invention is to provide a spark plug that can be easily removed from a plug hole of the internal-combustion engine.

SUMMARY OF THE INVENTION

A spark plug according to the present invention comprises:

a spark plug main body including a cylindrical metal shell, a cylindrical insulator accommodated in the metal shell, a center electrode extending in an axial direction and accommodated in the insulator, and a ground electrode having one end that is joined to an end portion of the metal shell and the other end that is disposed so as to form a gap with a front end portion of the center electrode, wherein the spark plug main body is fixed to an internal-combustion engine using a cylindrical pressing member that has a tool engagement portion in its upper portion and a male thread formed on an outer circumferential face of the pressing member so as to engage with a female thread of the plug hole of an internal-combustion engine, and wherein a removing-tool engagement portion for engaging with a tool when removing the spark plug main body from the internal-combustion engine is formed on an outer face of the other end side of the metal shell.

In the spark plug according to the present invention, the removing-tool engagement portion for engaging with the tool when removing the spark plug main body from the internal-combustion engine is formed on the outer circumferential face of the other end of the metal shell. Thus, although the spark plug main body is stuck in the plug hole due to soot or the sediment deposited in a clearance therebetween, the spark plug main body can be easily removed from the plug hole of the internal-combustion engine with a tool engaging with the removing-tool engagement portion.

In the spark plug according to the present invention, the metal shell includes: a caulking portion formed in the other end of the metal shell and holding the insulator therein by caulking; a buckling portion formed at the one end side of the metal shell with respect to the caulking portion and simultaneously deforming along with the caulking portion; and a thick portion formed between the caulking portion and the buckling portion and being thicker than the caulking portion and the buckling portion. The removing-tool engagement portion is formed in the thick portion. In this way, the removing-tool engagement portion is unlikely to be deformed when removing the spark plug main body from the plug hole of the internal-combustion engine.

According to the spark plug of the present invention, the removing-tool engagement portion may be composed of a male thread formed on an outer circumferential face of the thick portion. Further, in such a spark plug, all portions of the metal shell other than the thick portion have an outer diameter smaller than a core diameter of the male thread of the thick portion. In this way, when the removing-tool is engaged with the male thread, it is unlikely to come in contact with other portions of the spark plug main body. Thus, a front end portion of the removing-tool can come in contact with a wall of the plug hole while the removing-tool is engaged with the male thread of the spark plug main body. As a result, an axial force is generated in the spark plug main body by screwing the removing-tool. Therefore, the spark plug main body can be securely removed from the plug hole with the axial force.

The removing-tool engagement portion may be composed of a convex portion formed on the outer circumferential face of the thick portion. Such a spark plug may have a plurality of convex portions. In this way, the removing-tool can assuredly engage with the convex portion, whereby the spark plug main body can be securely removed from the plug hole of the internal-combustion engine.

In the spark plug according to the present invention, the convex portion satisfies a relationship: $S \times V >= 240$, where "S" ($mm^2$) is a sum of the cross-section areas of the convex portions sectioned perpendicular to the projecting direction of the convex portion, and where "V" (Hv) is Vickers hardness of the convex portion. Further, the convex portion satisfies a relationship: $H >= 0.5$, where "H" (mm) is a projection height of the convex portion from the outer circumferential face of the thick portion. In this way, the removing-tool assuredly engages with the convex portion, whereby the spark plug main body can be securely removed from the plug hole of the internal-combustion engine. Furthermore, the plurality of convex portions are formed around the axis O of the thick portion, 120 degrees apart from each other. Therefore, the removing-tool is unlikely to incline with respect to the spark plug main body when engaging with the spark plug main body.

In the present invention, the removing-tool engagement portion may be composed of a concave portion formed on the outer circumferential face of the thick portion. Such a spark plug may have a plurality of concave portions. In this way, the removing-tool can assuredly engage with the concave portion, whereby the spark plug main body can be securely removed from the plug hole of the internal-combustion engine. Furthermore, the plurality of concave portions are formed around the axis O of the thick portion, 120 degrees apart from each other. Therefore, the removing-tool is unlikely to incline with respect to the spark plug main body when engaging with the spark plug main body.

DETAILED DESCRIPTION OF THE INVENTION

Figure 1:
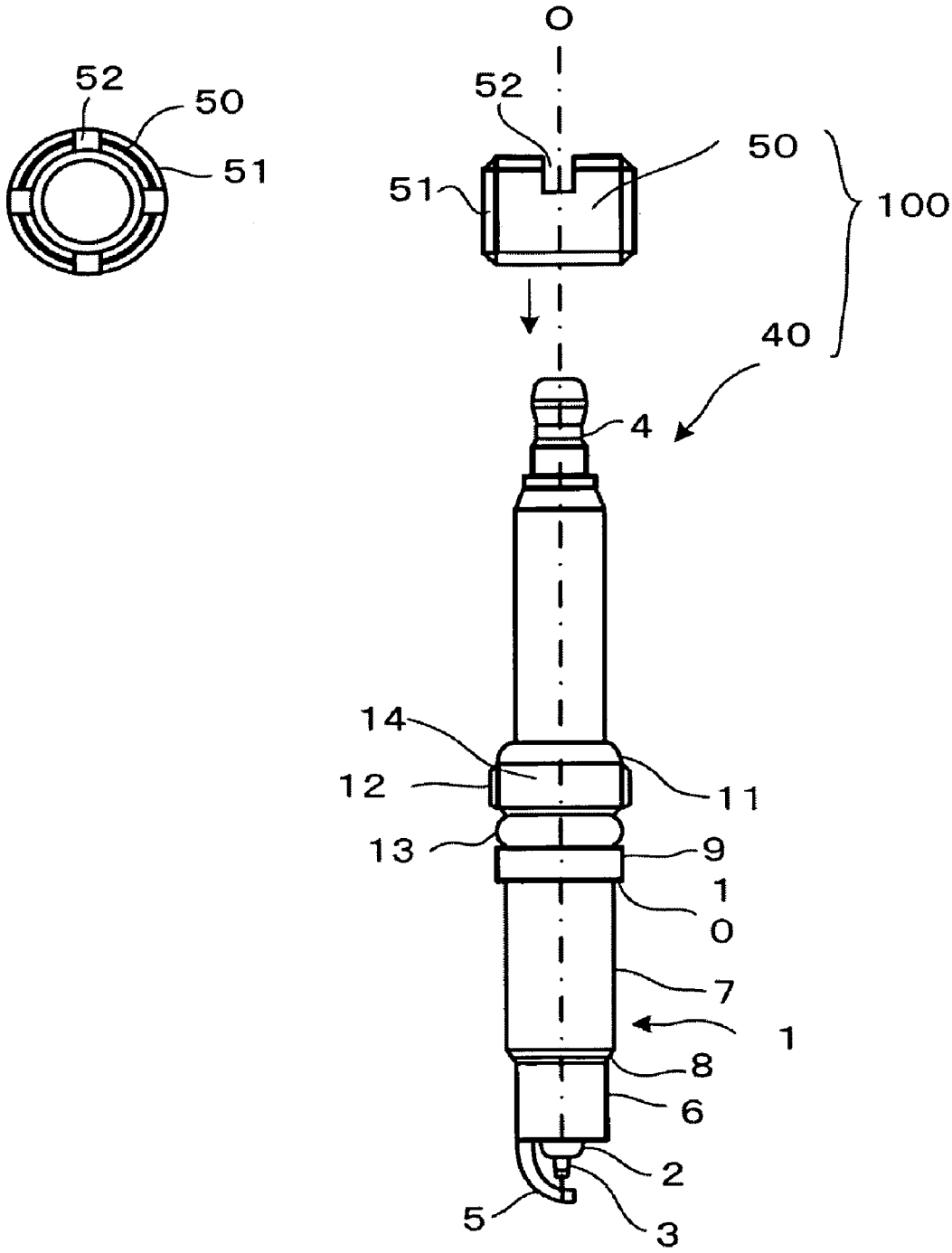
FIG. 1 is a view showing a composition of an entire spark plug according to an embodiment of the present invention.

An embodiment of the present invention will be described with reference to the drawings. FIG. 1 is a view showing a composition of an entire spark plug 100 according to an embodiment of the present invention. A dashed line in FIG. 1 shows an axial line O.

As shown in FIG. 1, the spark plug 100 comprises a spark plug main body 40 functioning as a spark plug and a cylindrical pressing member 50 for fixing the spark plug main body 40 to an internal-combustion engine.

The spark plug main body 40 includes a cylindrical metal shell 1 made of a metal, such as low carbon steel. An insulator 2 made of a ceramic sintered compact, such as alumina or alumimium nitride, is disposed in and held by the metal shell 1 so that a front end portion of the insulator 2 projects from an end face of the metal shell 1.

A center electrode 3 is accommodated in the insulator 2 so that a front end portion of the center electrode 3 projects from an end face of insulator 2. The center electrode 3 assumes a columnar shape and is made of a nickel alloy or the like. Typical materials of the center electrode 3 are Inconel 600 (brand name) (Ni:76 mass %, Cr:15.5 mass %, Fe:8 mass % (the remainders are a very-small-quantity of additive elements or impurities)), and Inconel 601 (brand name) (Ni:60.5 mass %, Cr:23 mass %, Fe:14 mass % (the remainders are a very-small-quantity of additive elements or impurities).

A noble metal tip may be disposed on a front end of the center electrode 3. The noble metal tip is, for example, made of Ir alloy containing Ir as a principal component and one or more kind of components selected from Pt, Rh, Ru and Re in total 3-50 mass % as an accessory ingredient, which controls oxidization and volatilization of Ir or improves workability. The noble metal tip assumes a cylindrical shape.

The center electrode 3 is disposed at a front end side (lower side in the drawing) of a penetration hole (not illustrated) formed in an axial O direction of the insulator 2. A terminal fitting 4 is disposed at a rear end side of the penetration hole formed in the axial O direction of the insulator 2. The terminal fitting 4 and the center electrode 3 are electrically connected through a conductive glass seal (not illustrated) or the like.

One end of a ground electrode 5 is joined to the end face of the metal shell 1 and the other end thereof is bent in a generally "L" shape so as to face the front end of the center electrode 3. A gap between the ground electrode 5 and the front end of the center electrode 3 serves as a spark gap for generating a spark discharge. A noble metal tip may be disposed on the ground electrode 5 at a position opposed to the center electrode 3.

The front end side of the metal shell 1 serves as a small diameter portion 6 having an outer diameter of, for example, 10 mm. A medium diameter portion 7 having an outer diameter of, for example, 12 mm is formed at the rear end side of the small diameter portion 6 (upper side in FIG. 1). Further, a taper portion 8 having an outer diameter gradually changing is formed between the medium diameter portion 7 and the small diameter portion 6. At the rear end side of the medium diameter portion 7 (upper side in FIG. 1), a large diameter portion 9 having an outer diameter of, for example, 14 mm is formed. Furthermore, a step portion 10 is formed in the boundary between the large diameter portion 9 and the medium diameter portion 7. In the rear end portion of the metal shell 1 (upper end in FIG. 1), a caulking portion 11 is formed so as to hold the insulator 2 in the metal shell 1 by caulking the caulking portion 11 into a large diameter portion (not illustrated) of the insulator 2. In addition, in the rear end side of the large diameter portion 9, a buckling portion 13 having a thickness thinner than that of other portions of the metal shell 1 is formed. The buckling portion 13 is bent when the caulking portion 11 is caulked.

Figure 2:
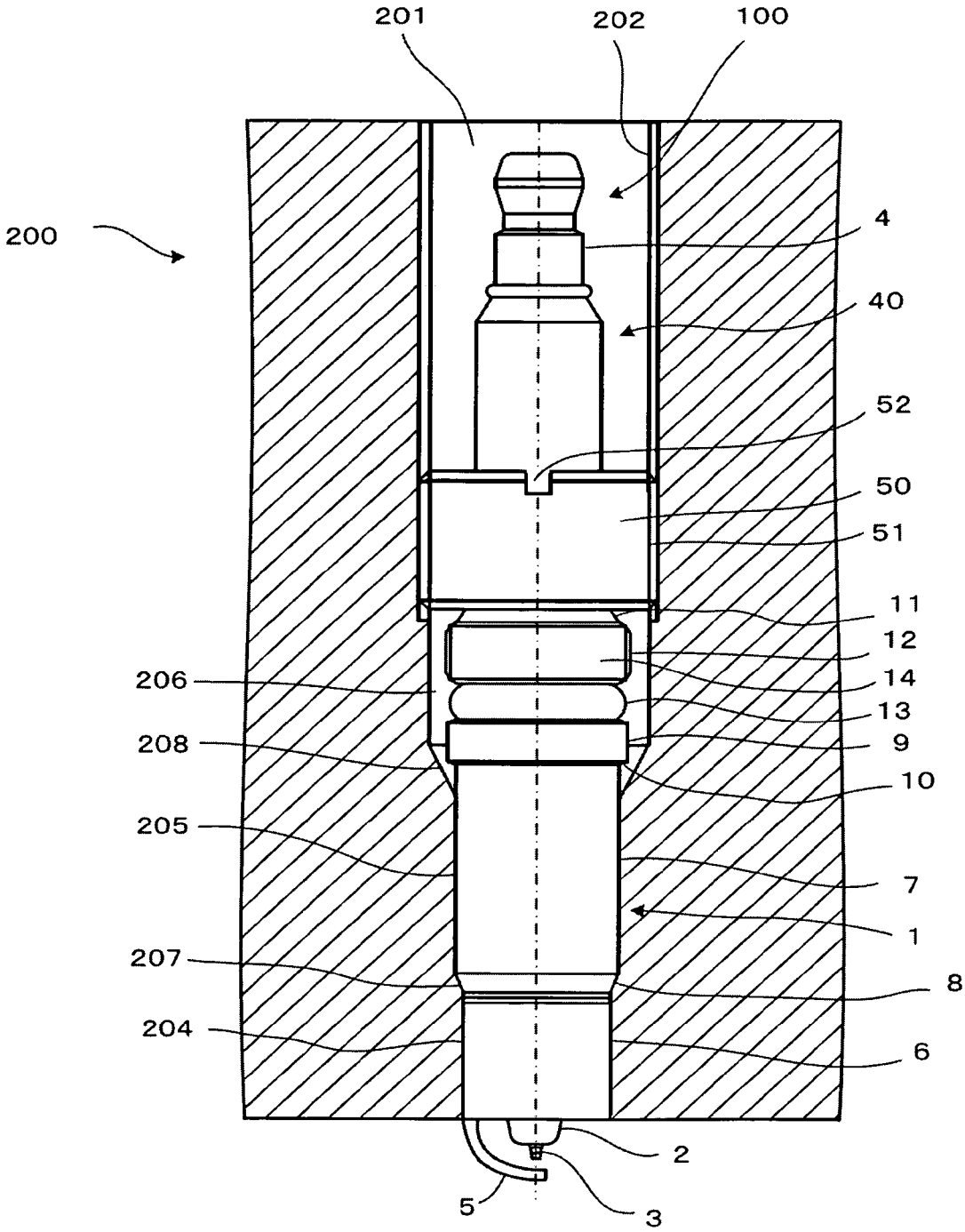
FIG. 2 shows the spark plug of FIG. 1 fixed to a plug hole.

Further, a thick portion 14 having a predetermined thickness is formed between the caulking portion 11 and the buckling portion 13 of the metal shell 1, and a removing-tool engagement portion 12 is formed on an outer circumferential face of the thick portion 14. In this embodiment, the removing-tool engagement portion 12 has a male thread thereon. The removing-tool engagement portion 12 is used for engaging with a tool when removing the spark plug main body 40 from an engine block 200 as shown in FIG. 2, but not used for fixing the spark plug main body 40 to the engine block 200. Therefore, when the spark plug main body 40 is fixed to the engine block 200 as shown in FIG. 2, the removing-tool engagement portion 12 is not in contact with any members of the engine block 200. In addition, no male thread is formed on the outer circumferential face of the metal shell 1 for fixing the spark plug main body 40 to the engine block 200 as shown in FIG. 2.

A cylindrical pressing member 50 for fixing the spark plug main body 40 to the engine block 200 is provided on the caulking portion 11. As illustrated on the upper left in FIG. 1, the cylindrical pressing member 50 assumes a generally cylindrical shape, and a male thread 51 is formed on the outer circumferential face thereof. Also, a plurality (four in FIG. 1) of recesses or concave portions (tool engagement portions) 52 used for engaging with a tool are formed on a top face of the cylindrical pressing member 50. The concave portions 52 are used for rotating the cylindrical pressing member 50 when a female thread 202 of a plug hole 201 shown in FIG. 2 is engaged with the male thread 51 of the cylindrical pressing member 50.

FIG. 2 shows a state where the spark plug main body 40 is inserted in and fixed to the plug hole 201 of the engine block 200. As shown in FIG. 2, the plug hole 201 of the engine block 200 has a small diameter portion 204, a medium diameter portion 205 and a large diameter portion 206 those of which correspond to the small diameter portion 6, the medium diameter portion 7 and the large diameter portion 9 of the metal shell 1, respectively. Further, a taper portion 207 corresponding to the taper portion 8 of the metal shell 1 is formed between the small diameter portion 204 and the medium diameter portion 205. Furthermore, a taper portion 208 having an inner diameter gradually changing is formed in the boundary between the medium diameter portion 205 and the large diameter portion 206.

When the spark plug main body 40 is inserted in the plug hole 201 of the engine block 200, the taper portion 8 of the metal shell 1 and the taper portion 207 of the plug hole 201 are brought into contact with each other. In this state, the male thread 51 of the cylindrical pressing member 50 engages with the female thread 202 of the plug hole 201 and tightened up to thereby fix the spark plug main body 40 to the engine block 200, while the taper portion 8 is pressed against the taper portion 207.

Figure 3:
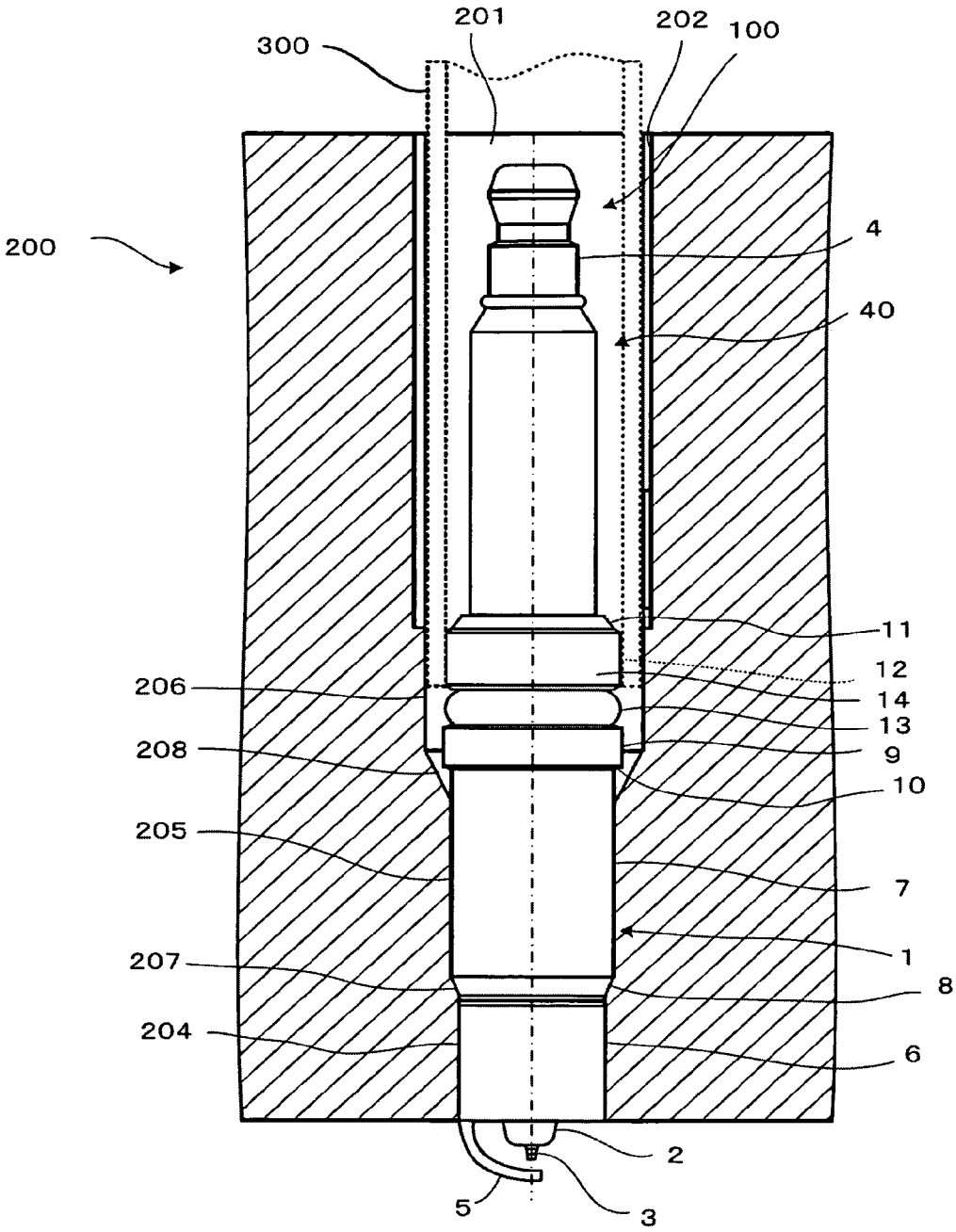
FIG. 3 shows the spark plug of FIG. 1 removed from a plug hole.

When removing the spark plug 100 from the engine block 200, the cylindrical pressing member 50 is, first, engaged with a tool and then rotated so as to remove the spark plug 100 from the plug hole 201. Next, as shown in FIG. 3, a removing-tool 300 (a dashed-line in FIG. 3) engages with the removing-tool engagement portion 12 of the spark plug main body 40. In this embodiment, since the removing-tool engagement portion 12 is composed of a male thread, the cylindrical removing-tool 300 having, for example, a female thread inside thereof engages with the male thread. Then, the spark plug main body 40 is removed using the removing-tool 300. Thus, even though the spark plug main body 40 is stuck in the plug hole 201 due to soot or the sediment deposited on the clearance between the plug hole 201 and the metal shell 1, the spark plug main body 40 can be easily removed from the plug hole 201 of the internal-combustion engine 200.

Figure 4:
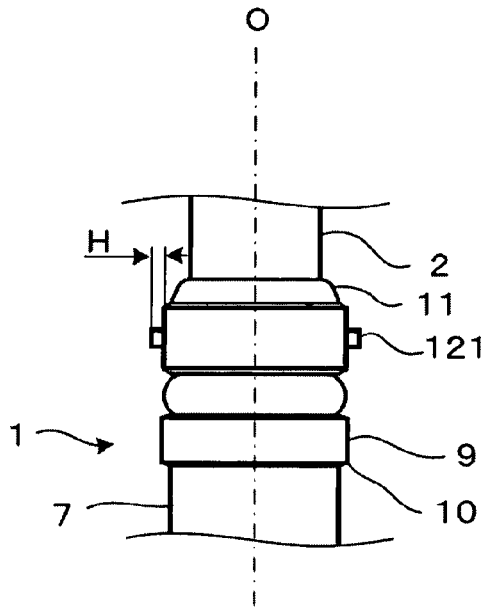
FIG. 4 is a view showing a composition of a modification of the embodiment in FIG. 1.
Figure 5:
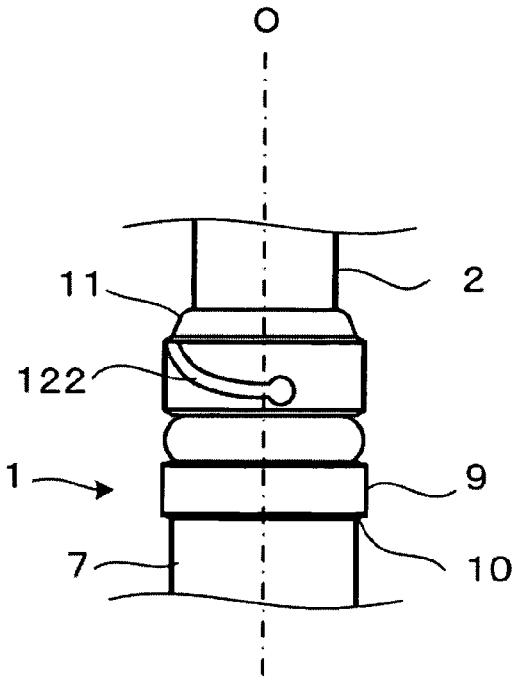
FIG. 5 is a view showing a composition of a modification of the embodiment in FIG. 1.

In the above-mentioned embodiment, although the removing-tool engagement portion 12 has the male thread, the present invention is not limited to this embodiment. The removing-tool engagement portion 12 can be any form as long as an engaging tool can remove the spark plug main body 40 from the plug hole 201. For example, as shown in FIG. 4, a removing-tool engagement portion 121 may be composed of a protuberance or convex portion formed on the outer circumferential face of the metal shell 1. Further, as shown in FIG. 5, for example, a recess or concave portion formed on the outer circumferential face of the metal shell 1 may constitute a removing-tool engagement portion 122. It is preferable that the removing-tool engagement portion 121 composed of the convex portion and the removing-tool engagement portion 122 composed of the concave portion be provided with more than one such portion. In this way, the removing-tool can assuredly engage with the removing-tool engagement portions 121,122, whereby the spark plug main body 40 can securely be removed from the plug hole 201. When two removing-tool engagement portions 121,122 are formed, as shown in FIGS. 4 and 5, they are disposed around the axis O so as to face each other (i.e., 180 degrees apart from each other). When three removing-tool engagement portions 121,122 are formed, they are disposed around the axis O, 120 degrees apart from each other. When four removing-tool engagement portions 121,122 are formed, they are disposed around the axis O, 90 degrees apart from each other.

As shown in FIG. 4, when the plurality of removing-tool engagement portions 121 are composed of the convex portions, the convex portion preferably satisfies a relationship: S×V>=240, where "S" ($mm^2$) is a sum of cross-section areas of the convex portions sectioned perpendicular to a projecting direction (i.e., the same direction to the axis O), and where "V" (Hv) is Vickers hardness of the convex portion. Table 1 below shows evaluation results of a plurality of spark plugs each having a different S×V value. In the evaluation, a single cylinder engine of 200 cc was run at 5000 rpm with W.O.T (full open) for 10 hours, and after that it was checked whether or not the spark plug main body 40 could be removed. The two convex portions were disposed around the axis O, 180 degrees apart from each other, and a height thereof was 1 mm. Therefore, "S" is the total cross-section areas of the two convex portions. Further, the difference in diameter between an engagement portion of the spark plug main body 40 and that of the plug hole 201 was 0.1 mm. In the result, "A" indicates that the spark plug main body 40 was able to be removed without any problem, and "B" indicates that the spark plug main body 40 was not able to be removed because of damage to the projecting convex portions.

TABLE 1

| Sample No. | V Hardness (HV) | Total cross-section areas of convex portions S ($mm^2$) | S × V | Result |
|---|---|---|---|---|
| No. 1 | 100 | 1 | 100 | B |
| No. 2 | 150 | 1 | 150 | B |
| No. 3 | 190 | 1 | 190 | B |
| No. 4 | 260 | 1 | 260 | A |
| No. 5 | 100 | 1.6 | 160 | B |
| No. 6 | 150 | 1.6 | 240 | A |
| No. 7 | 190 | 1.6 | 304 | A |
| No. 8 | 260 | 1.6 | 416 | A |
| No. 9 | 100 | 3.1 | 310 | A |
| No. 10 | 150 | 3.1 | 465 | A |
| No. 11 | 190 | 3.1 | 589 | A |
| No. 12 | 260 | 3.1 | 806 | A |
| No. 13 | 100 | 4 | 400 | A |
| No. 14 | 150 | 4 | 600 | A |
| No. 15 | 190 | 4 | 760 | A |
| No. 16 | 260 | 4 | 1040 | A |

As shown in Table 1, when the convex portion satisfies S×V>=240, the spark plug main body 40 was able to be removed from the plug hole 201. Therefore, the convex portion preferably satisfies the relationship of S×V>=240.

When the removing-tool engagement portion 121 is composed of the convex portion, the convex portion preferably satisfies a relationship: H>=0.5, where "H" (mm) is a projection height (i.e., length) of the convex portion from the outer circumferential face of the thick portion 14 as shown in FIG. 4. Table 2 below shows evaluation results that indicates whether or not the spark plug main body 40 was able to be removed from the plug hole 201. The plurality of spark plugs each having a different "H" (mm) was prepared for the evaluation. In the evaluation, a single cylinder engine of 200 cc was run at 5000 rpm with W.O.T (full open) for 10 hours, and after that it was checked whether the spark plug main body 40 was able to be removed or not. The two convex portions were disposed around the axis O, 180 degrees apart from each other. Hardness of the convex portion was V=190 HV, and the cross-section areas of the convex portions in total was S=3.1 $mm^2$. Further, the difference in diameter between an engagement portion of the spark plug main body 40 and that of the plug hole 201 was 0.1 mm. In the result, "A" indicates that the spark plug main body 40 was removed without any problems, and "B" indicates that the spark plug main body 40 was not able to be removed because a removing tool slipped.

TABLE 2

| Projection Height H (mm) | Result |
|---|---|
| 0.2 | B |

TABLE 2-continued

| Projection Height H (mm) | Result |
|---|---|
| 0.4 | B |
| 0.5 | A |
| 0.7 | A |
| 1 | A |
| 2 | A |

As shown in Table 2, when the projection height was H>=0.5 mm, the spark plug main body 40 was able to be removed from the plug hole 201. Therefore, the convex portion preferably satisfies the relationship of H>=0.5 mm.

Since the removing-tool engagement portion is used for engaging with a tool when removing the spark plug main body 40 from the engine block 200, the removing-tool engagement portion is necessarily provided in a portion of the metal shell 1 which has a predetermined mechanical strength. Although the removing-tool engagement portion is provided between the caulking portion 11 and the buckling portion 13 in the embodiment or provided on the outer circumferential face of the thick portion 14 that has a predetermined thickness (i.e., predetermined mechanical strength), the removing-tool engagement portion may be formed in any other portion of the metal shell 1, except for the thick portion 14, where a predetermined mechanical strength is secured.

Figure 6:
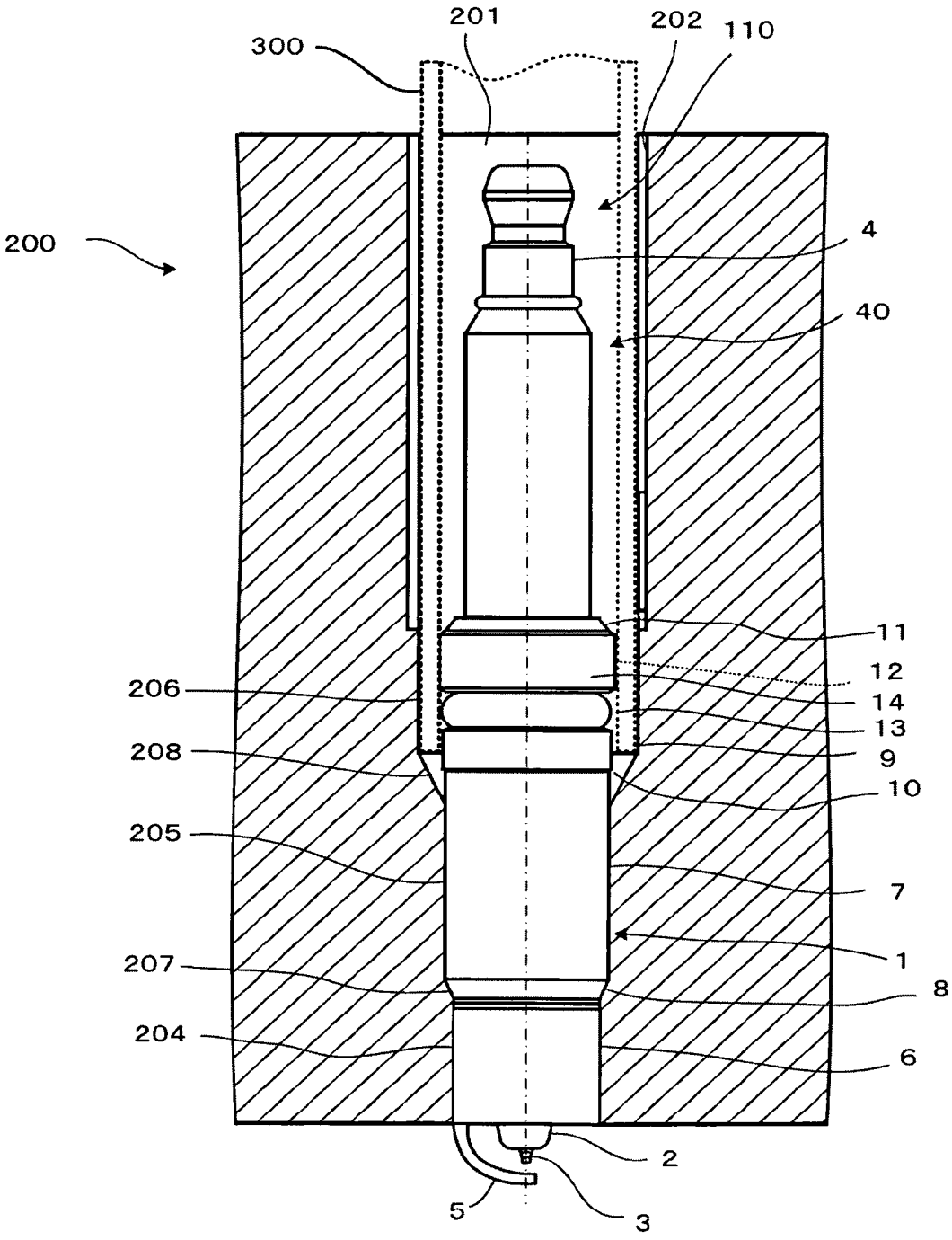
FIG. 6 is a view showing a composition of an entire spark plug according to another embodiment of the present invention.

FIG. 6 shows a composition of a spark plug 110 according to another embodiment of the present invention. The same reference numerals are provided to those similar to the composition of the spark plug 100. In the spark plug 110, all portions of the metal shell 1 other than the thick portion 14 have an outer diameter smaller than a core diameter of the male thread that constitutes the removing-tool engagement portion 12 of the thick portion 14. In this way, when the removing-tool 300 engages with the male thread, the removing-tool 300 is unlikely to come in contact with any portions of the spark plug main body 40. Thus, a front end portion of the removing-tool 300 can come in contact with the wall (the taper portion 208) of the plug hole 201, while the removing-tool 300 engages with the male thread of the spark plug main body 40. As a result, an axial force is generated in the spark plug main body 40 by screwing the removing-tool 300. Therefore, the spark plug main body 40 can be securely removed from the plug hole 201 by the axial force.

Although the invention has been described with reference to the specific embodiments thereof, the invention is not limited to the above-described embodiments, but various modifications will occur to those skilled in the art within the scope of the invention.

The spark plug according to the present invention is applicable to a spark plug used for internal-combustion engines, such as automotive engines. Therefore, the present invention has industrial applicability.

Having described the invention, the following is claimed:

1. A spark plug, comprising:

a spark plug main body including:

a cylindrical metal shell, a cylindrical insulator accommodated in the metal shell, a center electrode extending in an axial direction and accommodated in the insulator, a ground electrode having one end that is joined to a first end side of the metal shell and a free end that is disposed so as to form a gap with a front end portion of the center electrode, and a removing-tool engagement portion formed on an outer face of a second end side of the metal shell, said removing-tool engagement portion engaging with a tool for removing the spark plug main body from the internal-combustion engine by application of a force to the spark plug main body in the axial direction without rotation of the spark plug main body; and a cylindrical pressing member having a tool engagement portion in an upper portion, and a male thread formed on an outer circumferential face of the pressing member for engagement with a female thread of a plug hole of an internal-combustion engine to fix the spark plug main body to the internal combustion engine.

2. The spark plug according to claim 1, wherein the metal shell includes:

a caulking portion formed in the second end side of the metal shell and holding the insulator therein by caulking;

a buckling portion spaced from the caulking portion toward the first end side of the metal shell and simultaneously deforming with the caulking portion; and a thick portion formed between the caulking portion and the buckling portion and being thicker than the caulking portion and the buckling portion, wherein the removing-tool engagement portion is formed in the thick portion.

3. The spark plug according to claim 1, wherein the removing-tool engagement portion of the metal shell does not make contact with any members of the internal-combustion engine when said spark plug main body is fixed to the internal-combustion engine.

4. The spark plug according to claim 2, wherein the removing-tool engagement portion is comprised of a male thread formed on an outer circumferential face of the thick portion.

5. The spark plug according to claim 2, wherein the removing-tool engagement portion is comprised of one or more protuberances formed on the outer circumferential face of the thick portion.

6. The spark plug according to claim 2, wherein the removing-tool engagement portion is comprised of one or more recesses formed on the outer circumferential face of the thick portion.

7. The spark plug according to claim 4, wherein all portions of the metal shell other than the thick portion have an outer diameter smaller than a core diameter of the male thread formed on the outer circumferential face of the thick portion.

8. The spark plug according to claim 5 further includes a plurality of protuberances.

9. The spark plug according to claim 8, wherein the plurality of protuberances satisfy a relationship:

$$S \times V >= 240,$$

where "S" ($mm^2$) is a sum of cross-section areas of the protuberances sectioned perpendicular to a projecting direction of the protuberances, and where "V" (Hv) is Vickers hardness of each protuberance.

10. The spark plug according to claim 8, wherein the plurality of protuberances satisfy a relationship:

$$H >= 0.5,$$

where "H" (mm) is a projection height of each protuberance from the outer circumferential face of the thick portion.

11. The spark plug according to claim 8, wherein the plurality of protuberances are formed around an axis O of the thick portion, 120 degrees apart from each other.

12. The spark plug according to claim 6 further includes a plurality of recesses.

13. The spark plug according to claim 12, wherein the plurality of recesses are formed around an axis 0 of the thick portion, 120 degrees apart from each other.

* * * * *